US012723518B2

(12) United States Patent
MacManus et al.

(10) Patent No.: US 12,723,518 B2
(45) Date of Patent: Sep. 1, 2026

(54) HOT GAS PATH SEGMENT WITH SEAL SLOT COOLING GROOVE

(71) Applicant: GE Infrastructure Technology LLC, Greenville, SC (US)

(72) Inventors: Katherine Courtlyn MacManus, Greenville, SC (US); Ibrahim Sezer, Greenville, SC (US); Matthew Scott Lutz, Waterloo, SC (US); Joe Timothy Brown, Greenville, SC (US); Edward Bruno Mueller, IV, Chicago, IL (US)

(73) Assignee: GE Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 19/040,248

(22) Filed: Jan. 29, 2025

(65) Prior Publication Data

US 2026/0218617 A1 Jul. 30, 2026

(51) Int. Cl.

| | |
|---|---|
| ***F01D 9/06*** | (2006.01) |
| ***F01D 9/04*** | (2006.01) |
| ***F01D 11/24*** | (2006.01) |

(52) U.S. Cl.
CPC ..... *F01D 9/065* (2013.01); *F01D 9/041* (2013.01); *F01D 11/24* (2013.01)

(58) Field of Classification Search
CPC ..... F01D 9/042; F01D 9/065; F01D 11/24; F05D 2240/81; F05D 2260/205
See application file for complete search history.

(56) References Cited

U.S. PATENT DOCUMENTS

| | | | | |
|---|---|---|---|---|
| 4,902,198 | A | 2/1990 | North | |
| 5,167,485 | A | 12/1992 | Starkweather | |
| 5,531,457 | A | 7/1996 | Tibbott et al. | |
| 5,975,844 | A | 11/1999 | Milazar et al. | |
| 6,340,285 | B1 | 1/2002 | Gonyou et al. | |
| 7,217,081 | B2 * | 5/2007 | Scheurlen | F01D 5/22 277/642 |

(Continued)

FOREIGN PATENT DOCUMENTS

| | | |
|---|---|---|
| EP | 1162346 A2 | 12/2001 |
| FR | 2974839 A1 | 11/2012 |

OTHER PUBLICATIONS

Extend Search Report dated Jun. 17, 2026 for Application No. 26150148.0; pp. 11.

*Primary Examiner* — Brian P Wolcott
(74) *Attorney, Agent, or Firm* — James Pemrick; Charlotte Wilson; Hoffman Warnick LLC

(57) ABSTRACT

A HGP segment, such as a nozzle or shroud, for a GT system includes a body. A seal slot is defined in the face of side edge(s) of the body. Each seal slot has radial inner and outer walls, an inner sidewall between the radially inner and outer walls, and receives part of a sealing member extending between the seal slots of adjacent segments. Groove(s) are defined in one or both of the radial inner and outer walls of the seal slot and extend transverse to the slot. The groove(s) extend between the inner sidewall of the respective seal slot and the face of the respective side edge. A cooling passage is defined in the body and has an outlet defined in the inner sidewall within the at least one groove of the slot and an inlet in fluid communication with an inner coolant source defined in the body.

20 Claims, 7 Drawing Sheets

(56) References Cited

U.S. PATENT DOCUMENTS

| | | | | |
|---|---|---|---|---|
| 7,524,163 | B2 * | 4/2009 | Self | F01D 9/041 415/115 |
| 8,092,159 | B2 | 1/2012 | Maldonado | |
| 8,905,708 | B2 * | 12/2014 | Weber | F01D 11/005 415/173.1 |
| 9,518,475 | B2 * | 12/2016 | Weber | F01D 11/005 |
| 9,518,478 | B2 * | 12/2016 | Smith | F01D 11/005 |
| 10,982,559 | B2 * | 4/2021 | Filippi | F01D 11/005 |
| 11,506,129 | B2 * | 11/2022 | LoRicco | F01D 11/005 |
| 2013/0177383 | A1 | 7/2013 | Winn et al. | |
| 2014/0093353 | A1 | 4/2014 | Sezer et al. | |

* cited by examiner

HOT GAS PATH SEGMENT WITH SEAL SLOT COOLING GROOVE

TECHNICAL FIELD

The disclosure relates generally to gas turbine systems and, more particularly, to a hot gas path segment, such as a turbine nozzle or shroud, having a seal slot cooling groove.

BACKGROUND

Gas turbine systems include nozzle and shroud assemblies, each including a plurality of nozzles or shrouds disposed in an annular array and collectively defining a hot gas path. Adjacent nozzles or shrouds in a respective assembly have gaps between adjacent side edges that are sealed with a seal to prevent ingestion of the working fluid. Ingestion of the working fluid, such as hot combustion gases, can lead to overheating and premature maintenance of the nozzles or shrouds. Cooling of structure around the seal slot can extend component life by cooling the component and by creating a buffer to working fluid ingestion. However, due to space constraints, such cooling can be a challenge.

BRIEF DESCRIPTION

All aspects, examples, and features mentioned below can be combined in any technically possible way.

An aspect of the disclosure includes a hot gas path (HGP) segment for gas turbine system including at least one stage including a plurality of circumferentially adjacent HGP segments, the HGP segment comprising: a body including at least one face on a side edge of the body for addressing a corresponding face on the side edge of the body of an adjacent HGP segment; a seal slot defined in the face of each side edge and extending in a axial direction toward the opposite side edge, each seal slot having a radial inner wall, a radial outer wall and an inner sidewall between the radially inner and outer walls, wherein each seal slot is configured to receive part of a sealing member extending between the seal slots of the circumferentially adjacent HGP segments; at least one groove defined in at least one of the radial inner wall or the radial outer wall of each seal slot and extending transverse to the axial direction, each groove extending between the inner sidewall of the respective seal slot and the face of the respective side edge; and a cooling passage defined in the respective HGP segment and having an outlet defined in the inner sidewall within the at least one groove of the respective seal slot and an inlet in fluid communication with an inner coolant source defined in the body.

Another aspect of the disclosure includes any of the preceding aspects, and the HGP segment is a turbine nozzle, and the body includes: an airfoil including a tip and a root; a first endwall connected to the airfoil at the tip; a second endwall connected to the airfoil at the root; wherein each of the first and second endwalls include the at least one face; and wherein the inner coolant source is defined in at least a portion of the airfoil.

Another aspect of the disclosure includes any of the preceding aspects, and the HGP segment is a turbine shroud, and the body includes: a shroud body including the at least one face; wherein the inner coolant source is defined in at least a portion of the shroud body.

Another aspect of the disclosure includes any of the preceding aspects, and the at least one groove includes a plurality of grooves, each groove with a respective outlet directed therein.

Another aspect of the disclosure includes any of the preceding aspects, and the at least one groove includes one or more grooves in the radial inner wall and one or more grooves in the radial outer wall, each groove with a respective outlet directed therein.

Another aspect of the disclosure includes any of the preceding aspects, and the cooling passage includes a plurality of outlets defined in the inner sidewall within the at least one groove.

Another aspect of the disclosure includes any of the preceding aspects, and the at least one groove has one of a rectangular cross-section, a semi-circular cross-section, or a rounded rectangular cross-section.

Another aspect of the disclosure includes any of the preceding aspects, and a radial height of the at least one groove at the inner sidewall is less than a radial height of the at least one groove at the at least one face.

Another aspect of the disclosure includes, in a gas turbine system including at least one stage including a plurality of circumferentially adjacent segments, each segment having a body including at least one face on a side edge of the body for addressing a corresponding face on the side edge of the body of a circumferentially adjacent segment, a joint connection for the faces of the circumferentially adjacent segments comprises: a first seal slot defined in a first face of a first segment and extending in an axial direction, the first seal slot having a radial inner wall, a radial outer wall and an inner sidewall between the radial inner and outer walls, at least one groove defined in at least one of the radial inner or radial outer wall of the first seal slot and extending transverse to the axial direction, each groove extending between the inner sidewall of the first seal slot and the first face of the respective side edge of the first segment, and a cooling passage defined at least in part in the body of the first segment and having an outlet defined in the inner sidewall within the at least one groove and an inlet in fluid communication with an inner coolant source defined in the body of the first segment; a second seal slot defined in a second face of a second segment and extending in the axial direction, the second seal slot having a radial inner wall, a radial outer wall and an inner sidewall between the radial inner and outer walls of the second seal slot, at least one groove defined in at least one of the radial inner or outer walls of the second seal slot and extending transverse to the axial direction, each groove of the second seal slot extending between the inner sidewall of the second seal slot and the second face of the respective side edge of the second segment, and a cooling passage defined at least in part in the body of the second segment and having an outlet defined in the inner sidewall within the at least one groove in the second seal slot and an inlet in fluid communication with an inner coolant source defined in the body of the second segment; and a sealing member extending between the first and second seal slots of the circumferentially adjacent segments.

Another aspect of the disclosure includes any of the preceding aspects, and the sealing member includes a first side overlying the at least one groove in the seal slots of circumferentially adjacent segments and a second side opposite the at least one groove in the seal slots.

Another aspect of the disclosure includes any of the preceding aspects, and the first and second segments are turbine nozzles, the body of each turbine nozzle including: an airfoil including a tip and a root; a first endwall connected to the airfoil at the tip; a second endwall connected to the airfoil at the root; wherein each of the first and second endwalls include the at least one face; and wherein the inner coolant source is defined in at least a portion of the airfoil.

Another aspect of the disclosure includes any of the preceding aspects, and the first and second segments are turbine shrouds, the body of each turbine shroud including: a shroud body including the at least one face; wherein the inner coolant source is defined in at least a portion of the shroud body.

Another aspect of the disclosure includes any of the preceding aspects, and the at least one groove of at least one of the first seal slot and the second seal slot includes a plurality of grooves, each groove having a respective outlet of the cooling passage therein.

Another aspect of the disclosure includes any of the preceding aspects, and the at least one groove of at least one of the first seal slot and the second sea slot includes one or more grooves in the radial inner wall and one or more grooves in the radial outer wall, each groove having a respective outlet of the cooling passage therein.

Another aspect of the disclosure includes any of the preceding aspects, and the cooling passage defined in the body of at least one of the first segment and the second segment includes a plurality of outlets defined in the inner sidewall within the at least one groove.

Another aspect of the disclosure includes any of the preceding aspects, and the at least one groove has one of a rectangular cross-section, a semi-circular cross-section or a rounded rectangular cross-section.

Another aspect of the disclosure includes any of the preceding aspects, and a radial height of the at least one groove at the inner sidewall is less than a radial height of the at least one groove at the at least one face.

Another aspect of the disclosure includes a method, comprising: providing a seal slot in a hot gas path (HGP) segment for a gas turbine system including at least one stage including a plurality of circumferentially adjacent HGP segments where each HGP segment includes a body including at least one face on a side edge of the body for addressing a corresponding face on the side edge of the body of an adjacent HGP segment, wherein the seal slot is defined in each face and extends in an axial direction, the seal slot having a radial inner wall, a radial outer wall and an inner sidewall between the radially inner and outer walls thereof; providing at least one groove defined in at least one of the radial inner or radial outer wall of each seal slot and extending transverse to the axial direction, each groove extending between the inner sidewall of the respective seal slot and the face of the respective side edge; providing a cooling passage defined in the body of the HGP segment and having an outlet defined in the inner sidewall within the at least one groove of the seal slot and an inlet in fluid communication with an inner coolant source defined in the body of the segment; and cooling at least one of the radial inner wall or the radial outer wall during use of the gas turbine.

Another aspect of the disclosure includes any of the preceding aspects, and further comprising providing a sealing member in seal slots of adjacent HGP segments, the sealing member including a first side overlying the at least one groove in the seal slots of circumferentially adjacent HGP segments and a second side opposite the at least one groove.

Another aspect of the disclosure includes any of the preceding aspects, and the at least one groove includes a plurality of grooves, each groove having a respective outlet directed therein.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
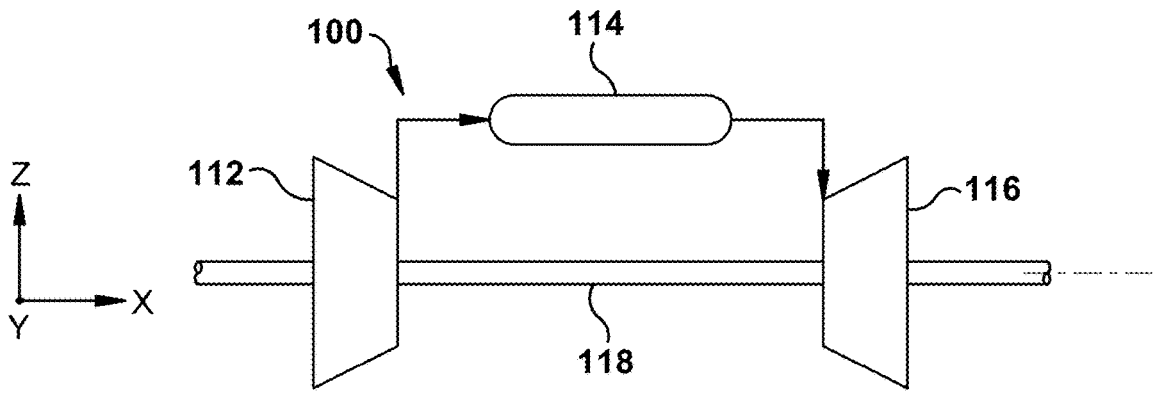
FIG. 1 is a schematic view of a gas turbine system, according to embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter in order to clearly describe the current technology, it will become necessary to select certain terminology when referring to and describing relevant machine components within a gas turbine system. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine section or, for example, the flow of air through the combustor or coolant through one of the turbine's components. The term "downstream" corresponds to the direction of flow of the fluid, and the term "upstream" refers to the direction opposite to the flow. The terms "forward" and "aft," without any further specificity, refer to directions, with "forward" referring to the front or compressor end of the system, and "aft" referring to the rearward or turbine end of the system.

It is often required to describe parts that are disposed at different radial positions with regard to a center axis. The term "radial" refers to movement or position perpendicular to an axis, e.g., in a Z-direction from an X-axis of a turbine shaft. In such cases, if a first component resides closer to the axis than a second component, it will be stated herein that the first component is "radially inner," "radially inward" or "inboard" of the second component. If, on the other hand, the first component resides further from the axis than the second component, it may be stated herein that the first component is "radially outer," "radially outward" or "outboard" of the second component. The term "axial" refers to movement or position parallel to an axis, e.g., an X-axis of a turbine shaft. Finally, the term "circumferential" refers to movement or position around an axis, e.g., in a Y-plane perpendicular to an X-axis of a turbine shaft. It will be appreciated that such terms may be applied in relation to the center axis of the turbine.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described feature or element may or may not be present, and that the description includes instances where the feature is present and instances where it is not.

Where an element or layer is referred to as being "on," "engaged to," "connected to" or "coupled to" another element or layer, it may be directly on, engaged, connected, or coupled to the other element or layer, or intervening elements or layers may be present. In contrast, when an element is referred to as being "directly on," "directly engaged to," "directly connected to" or "directly coupled to" another element or layer, no intervening elements or layers are present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Embodiments of the disclosure include a hot gas path (HGP) segment for a gas turbine (GT) system including at least one stage including a plurality of circumferentially adjacent HGP segments, such as turbine nozzles or shrouds. The disclosure also includes a joint connection for adjacent HGP segments and a related method of cooling the area proximate to the joint connection. The HGP segment includes a body including at least one face on a side edge of the body for addressing a corresponding face on the side edge of the body of an adjacent segment. More particularly, each side edge may have a face, sometimes referenced as a slash face, extending between opposing surfaces thereof for addressing the face of an adjacent segment. A seal slot, sometimes referenced as a seal pocket, is defined in the face of each side edge and extends in a direction toward the opposite side edge, i.e., in a generally circumferential direction. Each seal slot has a radial inner wall, a radial outer wall and an inner sidewall between the radially inner and outer walls and is configured to receive part of a sealing member extending between the seal slots of the circumferentially adjacent segments.

The HGP segment also includes at least one groove defined in at least one of the radial inner and radial outer wall of each seal slot and extending transverse to the direction of the seal slot. Each groove extends between the inner sidewall of the respective seal slot and the face of the respective side edge, i.e., creating a radial enlargement of the seal slot. A cooling passage is defined in the respective HGP segment and has an outlet defined in the inner sidewall within the at least one groove of the respective seal slot and an inlet in fluid communication with an inner coolant source defined in the body. In this manner, coolant can be directed into the groove(s) to cool the portion of the body of the segment around the slot (including the joint connection between adjacent HGP segments), which typically is hard to cool. The coolant is not directed onto the sealing member, although the sealing member may experience some ancillary cooling therefrom. The teachings of the disclosure are easy to manufacture during initial manufacture and/or repair of the segments without violating any tolerances of the seal slots, which are relatively tight to ensure proper operation of the sealing member therein.

Figure 2:
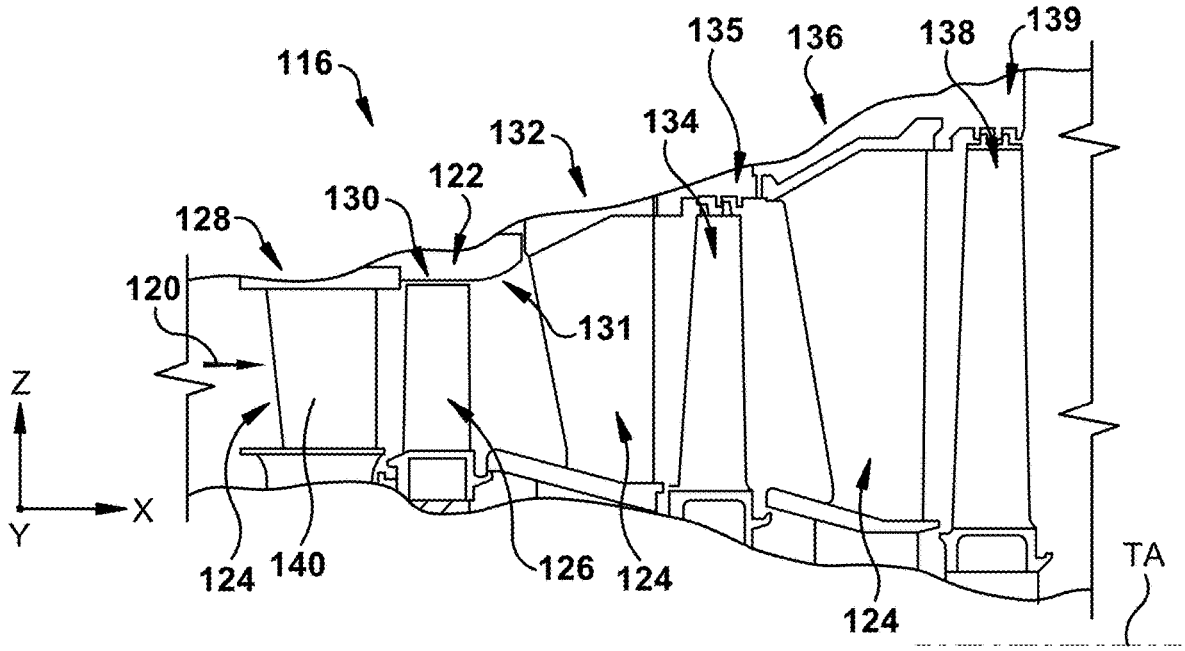
FIG. 2 is a cross-sectional view of a turbine section of a turbine system (e.g., the gas turbine system of FIG. 1), according to embodiments of the disclosure.

As will be described herein, a HGP segment may a stationary segment of a turbine nozzle or a turbine shroud. The turbine nozzle includes a body having an airfoil including a tip and a root. The turbine nozzle may also include first and second endwalls connected to the airfoil at the tip and the root, respectively. Each of the endwalls includes at least one face, e.g., typically two opposing faces. The inner coolant source is defined in at least a portion of the airfoil. The turbine shroud has a body including a shroud body including at least one face, e.g., typically two opposing faces. The inner coolant source is defined in at least a portion of the shroud body. As understood in the art, the surfaces of the bodies of the turbine nozzle or shroud are configured to mate with surfaces of the body of an adjacent nozzle or shroud to define a substantially curved portion of a hot gas path. A sealing member spans the gap, sometimes referenced as a "chute", between the faces of adjacent nozzles or shrouds. While embodiments of the disclosure will be described relative to a stationary HGP segment, it will be recognized that the teachings of the disclosure are equally applicable to rotating structure, such as turbine rotor blades 126 (FIGS. 2, 4B). More particularly, the teachings of the disclosure may be applied to platforms of turbine rotor blades 126 (FIGS. 2, 4B) in a similar manner as described herein for a turbine nozzle or shroud.

FIG. 1 is a schematic diagram of an illustrative turbine system 100, such as a gas turbine (GT) system, that uses stationary HGP segments 102 (FIGS. 3-4B) according to embodiments of the disclosure. It should be understood that turbine system 100 of the present disclosure need not be a gas turbine system, but rather may be any suitable turbine system, such as a steam turbine system, jet engine, or other suitable system. Turbine system 100 may include a compressor section 112, a combustor section 114, and a turbine section 116 (e.g., an expansion turbine section). Compressor section 112 and turbine section 116 may be coupled by a shaft 118. Shaft 118 may be a single shaft or a plurality of shaft segments coupled together to form shaft 118. Shaft defines an X axis of turbine system 100 (labeled in FIG. 2 as "TA" for "turbine axis").

As is generally known in the art, air or another suitable working fluid flows through and is compressed in compressor section 112. The compressed working fluid is then supplied to combustor section 114, wherein it is combined with fuel and combusted, creating hot combustion gases. After the hot combustion gas flows through combustor section 114, it may flow into and through turbine section 116.

FIG. 2 illustrates one embodiment of portions of turbine section 116 according to the present disclosure. A hot gas path 120 may be defined within turbine section 116. Various hot gas path components, such as shrouds 122, stationary nozzles 124, and turbine rotor blades 126, may be at least partially disposed in hot gas path 120. For example, as shown, turbine section 116 may include a plurality of nozzles 124 and a plurality of turbine rotor blades 126. Further, plurality of nozzles 124 and plurality of turbine rotor blades 126 may be disposed in one or more annular arrays, each of which may define a portion of hot gas path 120.

Turbine section 116 may include a plurality of turbine stages. The stages include a plurality of circumferentially adjacent HGP segments 102 (as labeled in FIGS. 3-4B). Each stage may include a plurality of nozzles 124 disposed in an annular array and a plurality of turbine rotor blades 126 disposed in an annular array immediately downstream of plurality of nozzles 124. Each stage may also include a plurality of shrouds 122 disposed in an annular array, i.e., radially outward of a respective plurality of turbine rotor blades 126. For example, as shown in FIG. 2, in one embodiment, turbine section 116 may have three stages. For example, a first stage of turbine section 116 may include a first stage nozzle assembly 128, a first stage blade assembly 130 and a first stage shroud assembly 131. Nozzle assembly 128 may include a plurality of nozzles 124 disposed and fixed circumferentially about shaft 118. Blade assembly 130 may include a plurality of turbine rotor blades 126 disposed circumferentially about shaft 118 and coupled to shaft 118. Shroud assembly 131 may include a plurality of shrouds 122 disposed circumferentially about shaft 118 and fixed circumferentially about shaft 118, e.g., in a stationary turbine casing (not shown).

A second stage of turbine section 116 may include a second stage nozzle assembly 132, a second stage blade assembly 134 and a second stage shroud assembly 135. Nozzles 124 included in second stage nozzle assembly 132 may be disposed and fixed circumferentially about shaft 118. Turbine rotor blades 126 included in second stage blade assembly 134 may be disposed circumferentially about shaft 118 and coupled to shaft 118. Shrouds 122 included in second stage shroud assembly 135 may be disposed and fixed circumferentially about shaft 118. Second stage nozzle assembly 132 is positioned between first stage blade assembly 130 and second stage blade assembly 134 (and second stage shroud assembly 135) along hot gas path 120.

A third stage of turbine section 116 may include a third stage nozzle assembly 136, a third stage blade assembly 138 and a third stage shroud assembly 139. Nozzles 124 included in third stage nozzle assembly 136 may be disposed and fixed circumferentially about shaft 118. Turbine rotor blades 126 included in third stage blade assembly 138 may be disposed circumferentially about shaft 118 and coupled to shaft 118. Shrouds 122 included in third stage shroud assembly 139 may be disposed and fixed circumferentially about shaft 118. Third stage nozzle assembly 136 is positioned between second stage blade assembly 134 and third stage blade assembly 138 (and third stage shroud assembly 139) along hot gas path 120.

It should be understood that turbine section 116 is not limited to three stages, but rather that any number of stages are within the scope and spirit of the present disclosure. For example, turbine section 116 may include four stages. It should be understood that shrouds 122 and nozzles 124 according to the present disclosure are not limited to components in turbine section 116. Rather, shrouds 122 and nozzles 124 may be components at least partially disposed in flow paths for compressor section 112 or any other suitable sections of turbine system 100. Further, it should be understood that shrouds 122 in shroud assemblies 131, 135, 139, and nozzles 124 in nozzle assemblies 128, 132, and 136 may be fixedly coupled to a turbine casing (not shown) that circumscribes shaft 118. Shrouds 122 and nozzles 124 may be HGP segments 102 according to embodiments of the disclosure.

Figure 3:
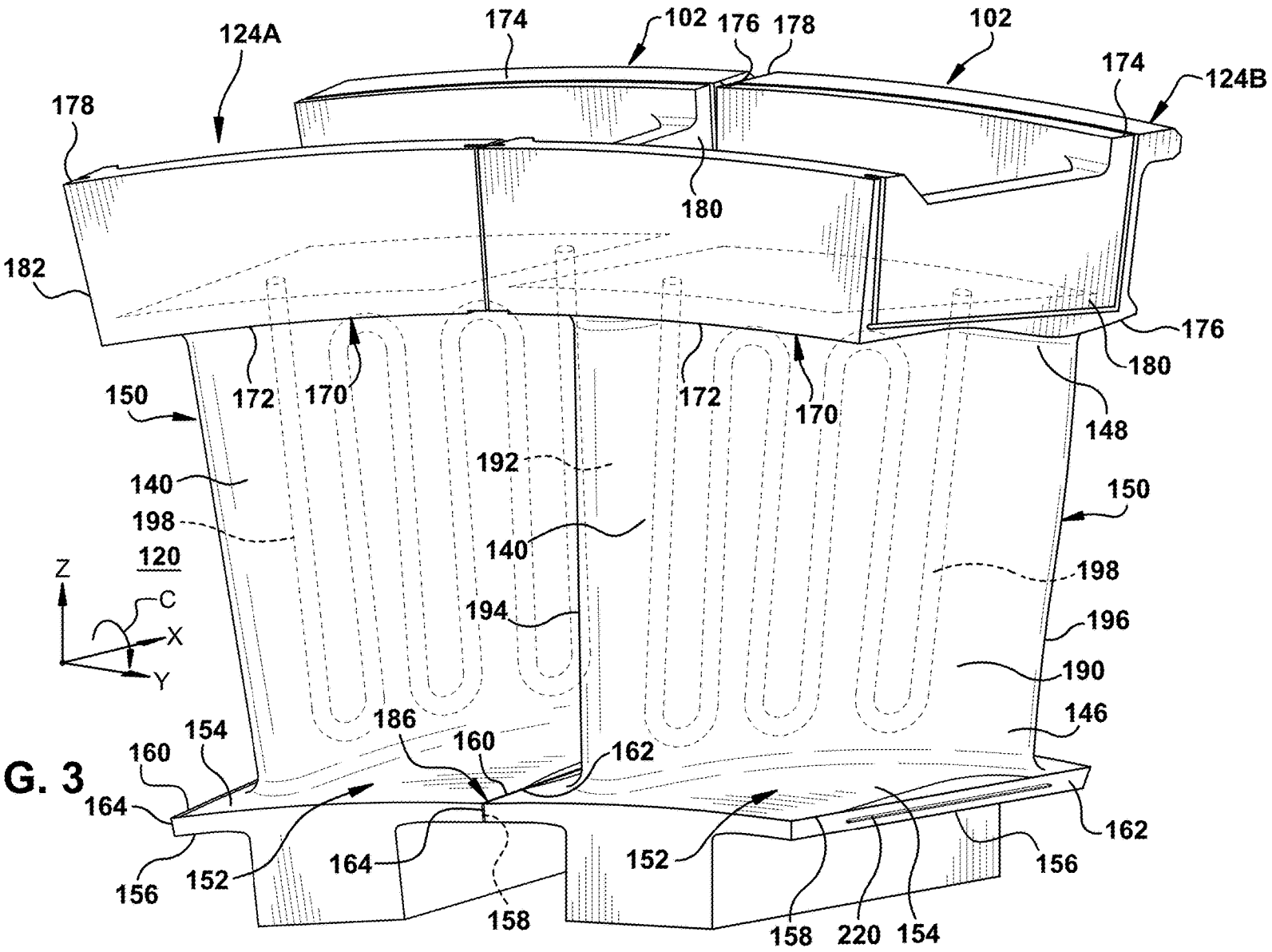
FIG. 3 is a perspective view of a hot gas path (HGP) segment in the form of a turbine nozzle, according to embodiments of the disclosure.
Figure 4A:
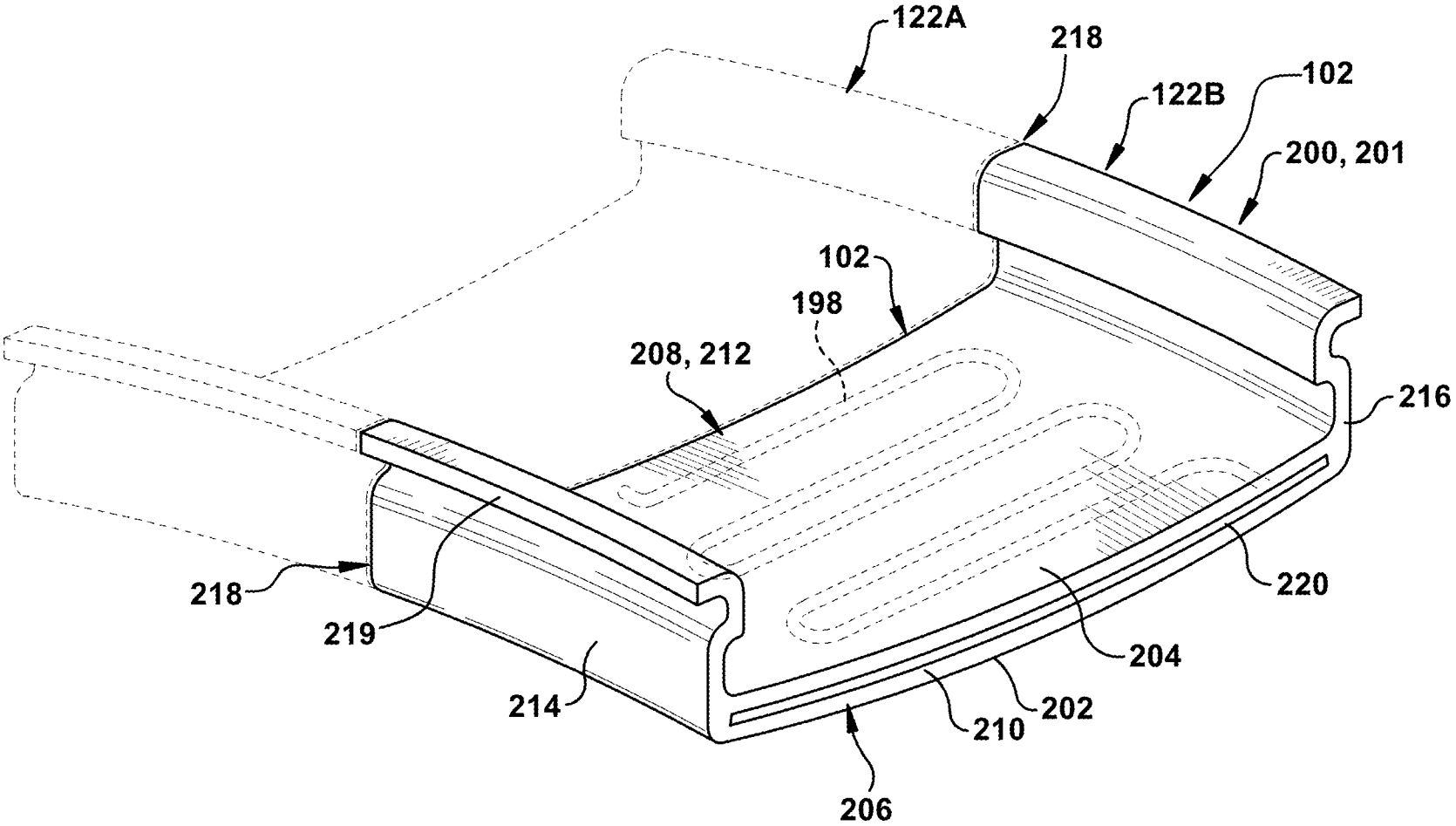
FIG. 4A is a perspective view of a hot gas path segment in the form of a turbine shroud, according to embodiments of the disclosure.
Figure 4B:
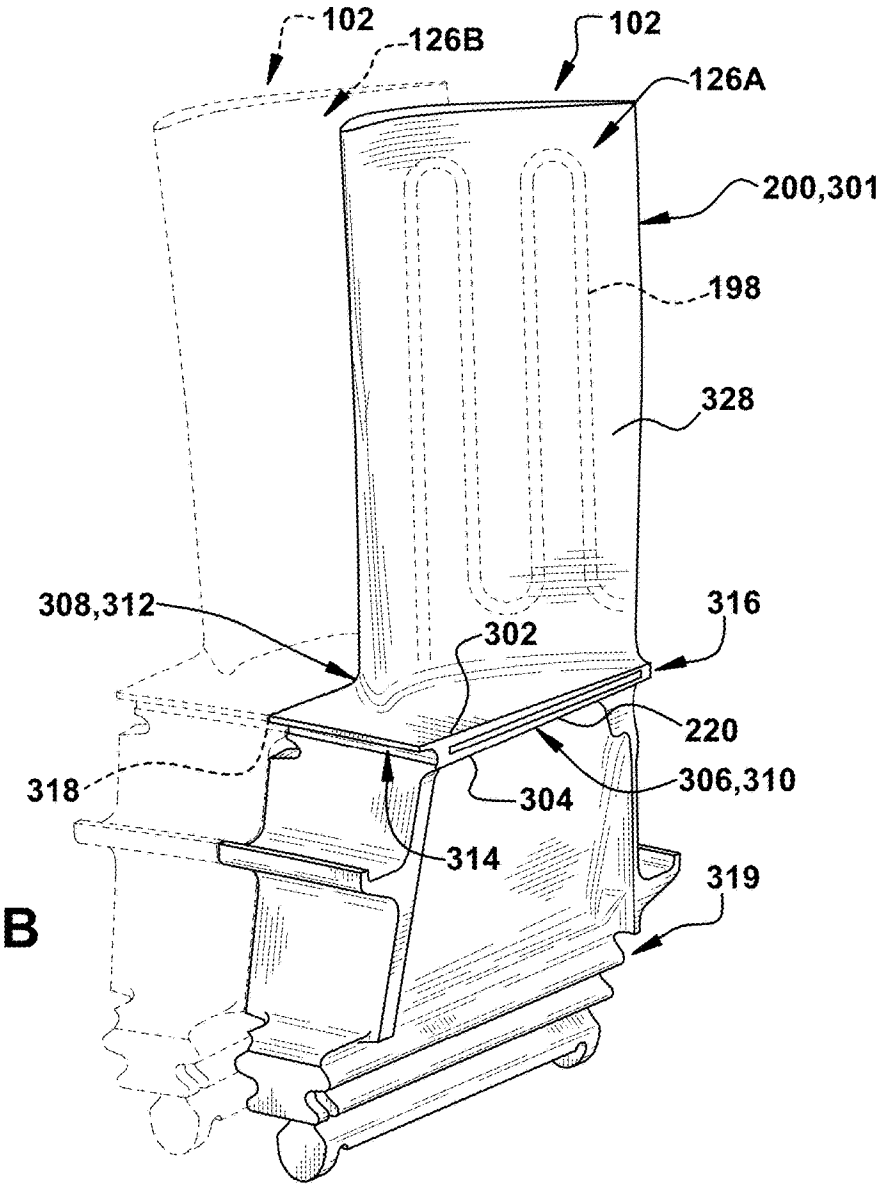
FIG. 4B is a perspective view of a hot gas path segment in the form of a turbine blade, according to embodiments of the disclosure.

FIGS. 3, 4A, and 4B show side perspective views of embodiments of HGP segment(s) 102 for turbine system 100 (hereafter "GT system 100" to correspond to illustrative form in the drawings). GT system 100 includes at least one stage (with assemblies 128, 131, 132, 135, 136, 139 (FIG. 2)) including a plurality of circumferentially adjacent HGP segments 102. As will be described further herein, HGP segments 102 include a body including at least one face on a side edge of the body for addressing a corresponding face on the side edge of the body of an adjacent segment. Each face extends between opposing surfaces of the body for addressing the face of an adjacent segment.

FIG. 3 shows a side perspective view of embodiments of a pair of HGP segments 102 in the form of a pair of adjacent singlet nozzles 124A, 124B for GT system 100 (FIG. 1). It will be recognized that while nozzles 124 are shown as singlets, more than one airfoil 140 may be coupled to each endwall 152, 170 to form multiple nozzle 124 segments (e.g., doublets or triplets). For purposes of simplicity of description, only singlet nozzles 124 will be illustrated. It is emphasized that the teachings of the disclosure are equally applicable to multiple nozzle HGP segments 102 including more than one airfoil 140 coupled to respective endwalls 152, 170. In any event, with reference to FIGS. 2 and 3, nozzles 124 in illustrative embodiments may be used as a first stage nozzle 124, thus utilized in first stage nozzle assembly 128 (FIG. 2). In other embodiments, however, nozzle 124 could be a second stage nozzle 124 utilized in second stage nozzle assembly 132 (FIG. 2). In yet other embodiments, nozzle 124 can be a third stage nozzle 124 utilized in third stage nozzle assembly 136 (FIG. 2), or any other suitable nozzle utilized in any suitable stage or other assembly, in turbine section 116, compressor section 112, or otherwise.

As shown, nozzle 124 according to the present disclosure includes a body 150 including at least one face on a side edge of the body for addressing a corresponding face on the side edge of an adjacent segment. As used herein, "addressing" indicates the faces are positioned close to one another, but slightly spaced apart, and/or may contact or abut one another along at least part of their axial extents. Each body 150 includes a set of opposing surfaces and a pair of opposing side edges. For example, nozzle 124 may include a first set of the afore-mentioned structure on an inner endwall 152. For nozzles 124, body 150 also includes airfoil 140 including a tip 146 and a root 148. Body 150 also includes inner endwall 152 connected to airfoil 140 at tip 146. Inner endwall 152 has a surface 154 (exposed to hot gas path 120) and an opposing surface 156 and a pair of opposing side edges 158, 160. Each side edge 158, 160 has a face 162, 164, respectively, extending between opposing surfaces 154, 156 for addressing a face 164, 162, respectively, of an adjacent segment 102.

Body 150 of nozzle 124 may also include at least one face on outer endwall 170. That is, nozzle 124 may include body 150 with a second set of the opposing surfaces and a pair of opposing side edges on outer endwall 170. More particularly, body 150 may also include outer endwall 170 connected to airfoil 140 at root 148. Outer endwall 170 has a surface 172 (exposed to hot gas path 120) and an opposing surface 174 and a pair of opposing side edges 176, 178. Each side edge 176, 178 has a face 180, 182, respectively, extending between opposing surfaces 172, 174 for addressing face 182, 180, respectively, of an adjacent segment 102.

As shown in the exemplary embodiment of FIG. 3, inner endwall 152 of nozzle 124A includes surface 154 configured to mate with surface 154 of inner endwall 152 of an adjacent nozzle 124B, to define a curved portion of hot gas path 120. Surfaces 154 of inner endwalls 152 extend in a contiguous, convexly arcuate manner to side faces 162, 164 where a gap or space 186 between side faces 162, 164 interrupts the surface. That is, surface 154 is, excepting where airfoil 140 is connected, convexly arcuate along its entire extent of inner endwalls 152. Similarly, as shown in FIG. 3, each outer endwall 170 of nozzle 124A includes surface 172 configured to mate with surface 172 of outer endwall 170 of an adjacent nozzle 124B, to define a curved portion of hot gas path 120. For outer endwalls 170, the curved portion of surface 172 is concavely arcuate, to collectively form, for a given nozzle assembly, a radially inwardly facing substantially circular wall defining a radially outer extent of hot gas path 120. In this context, "substantially circular" indicates surfaces 154, 172 across a given nozzle assembly collectively are circular excepting minor deviations for the locations of gaps between faces 162, 164, 180, 182 thereof or airfoils 140 thereof. Each nozzle 124 may also include any now known or later developed mounting system (not separately labeled for clarity) for mounting nozzle 124 to a casing of turbine section 116.

Airfoil 140 extends between inner and outer endwalls 152, 170 and is connected thereto. Airfoil 140 includes exterior surfaces defining a pressure side 190, a suction side 192, a leading edge 194, and a trailing edge 196. As is generally known, pressure side 190 and suction side 192 each generally extend between leading edge 194 and trailing edge 196. Airfoil 140 further defines and extends between tip 146 and root 148. Again, inner endwall 152 is connected to airfoil 140 at tip 146, while outer endwall 170 is connected at root 148. Airfoil 140 may include an inner coolant source 198 at least partially therein that may take a variety of well-known forms.

FIG. 4A shows a side perspective view of embodiments of a pair of HGP segments 102 in the form of a pair of adjacent shrouds 122A, 122B for GT system 100 (FIG. 1), according to other embodiments of the disclosure. Shrouds 122 in illustrative embodiments may be used as a first stage shroud 122, thus utilized in first stage shroud assembly 131 (FIG. 2). In other embodiments, however, shroud 122 could be a second stage shroud 122 utilized in second stage shroud assembly 135 (FIG. 2). In yet other embodiments, shroud 122 can be a third stage shroud 122 utilized in third stage shroud assembly 139 (FIG. 2), or any other suitable shroud utilized in any suitable stage or other assembly, in turbine section 116, compressor section 112, or otherwise.

As shown, shroud 122 (e.g., shroud 122B) according to the present disclosure includes a body 200. Body 200 includes a shroud body 201, i.e., having a desired shape for where shroud is located, and includes at least one face. More particularly, shroud body 201 may include a surface 202 (exposed to hot gas path 120), an opposing surface 204 and a pair of opposing side edges 206, 208. Each side edge 206, 208 has a face 210, 212 extending between opposing surfaces 202, 204 for addressing face 212, 210 of an adjacent segment 102 (e.g., shroud 122A, shown in phantom lines in FIG. 4A). Hence, shroud 122, unlike nozzle 124, includes a single set of opposing surfaces 202, 204 and a single pair of opposing side edges 206, 208 including faces 210, 212. Shroud 122 may also include a leading edge face 214 and a trailing edge face 216. Faces 210, 212 are at respective circumferential edges, respectively, of shroud 122, i.e., a farthest circumferentially extending edge thereof. Shroud body 201 may include an inner coolant source 198 at least partially therein that may take a variety of well-known forms. Each shroud 122 may also include any now known or later developed mounting system 219 for mounting shroud 122 to a casing of turbine section 116.

As shown in FIG. 4A, surface 202 of shroud, e.g., 122A, is configured to mate with surface 202 of an adjacent shroud, e.g., 122B, to define a curved portion of hot gas path 120. Surfaces 202 of shrouds 122 extend in a contiguous, concavely arcuate manner to side faces 210, 212 where a gap or space 218 between side faces 210, 212 interrupts the surface. That is, surfaces 202 are concavely arcuate along their entire extent of shrouds 122. The concavely arcuate shrouds 122, collectively form, for a given shroud assembly 131, 135, 139 (FIG. 2), a radially inwardly facing substantially circular wall defining a radially outer extent of hot gas path 120. In this context, "substantially circular" indicates surfaces 202 across a given shroud assembly are circular, collectively, excepting minor deviations for the locations of gaps 218 between faces 210, 212 thereof.

FIG. 4B shows a side perspective view of embodiments of a pair of HGP segments 102 in the form of a pair of adjacent turbine rotor blades 126A, 126B for GT system 100 (FIG. 1), according to other embodiments of the disclosure. Blades 126 in illustrative embodiments may be used as a first stage blade 126, thus utilized in first stage blade assembly 130 (FIG. 2). In other embodiments, however, blade 126 could be a second stage blade 126 utilized in second stage blade assembly 134 (FIG. 2). In yet other embodiments, blade 126 can be a third stage blade 126 utilized in third stage blade assembly 138 (FIG. 2), or any other suitable blade utilized in any suitable stage or other assembly, in turbine section 116, compressor section 112, or otherwise.

As shown, blade 126 according to the present disclosure includes a body 200. Body 200 (e.g., of blade 126A) includes a blade body 301, i.e., having a desired shape for where blade is located, and includes at least one face. More particularly, blade body 301 may include a surface 302 (e.g., exposed to hot gas path 120), an opposing surface 304 and a pair of opposing side edges 306, 308. Each side edge 306, 308 has a face 310, 312 extending between opposing surfaces 302, 304 for addressing face 312, 310 of an adjacent segment 102 (e.g., blade 126B, shown in phantom lines in FIG. 4B). Hence, blade 126, unlike nozzle 124, includes a single set of opposing surfaces 302, 304 and a single pair of opposing side edges 306, 308 including faces 310, 312. Blade 126 may also include a leading edge face 314 and a trailing edge face 316. Faces 310, 312 are at respective circumferential edges, respectively, of blade 126, i.e., a farthest circumferentially extending edge thereof. Blade body 301 may include an inner coolant source 198 at least partially therein that may take a variety of well-known forms. Each blade 126 may also include any now known or later developed mounting system 319 for mounting blade 126 to a rotor disc or wheel of shaft 118 within turbine section 116.

As shown in FIG. 4B, surface 302 of blade, e.g., 126A, is configured to mate with surface 302 of an adjacent blade, e.g., 126B, to define a curved portion of hot gas path 120. Surfaces 302 of blades 126, except where an airfoil 328 thereof intercedes, extend in a contiguous, convexly arcuate manner to side faces 310, 312 where a gap or space 318 between side faces 310, 312 interrupts the surface. That is, surfaces 302 are convexly arcuate along their extent outside of airfoils 328 of blades 126. The blades 126, for each given blade assembly 130, 134, 138 (FIG. 2), collectively form a radially outwardly facing substantially circular wall defining a radially inner extent of hot gas path 120. In this context, "substantially circular" indicates surfaces 302 across a given blade assembly are circular, collectively, excepting deviations for airfoils 328 and for the locations of gaps 318 between faces 310, 312 thereof.

Figure 6:
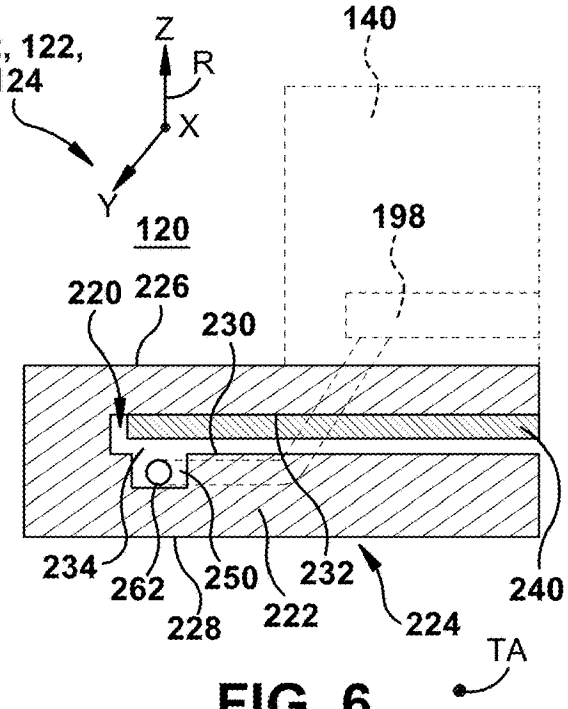
FIG. 6 is a schematic, axial cross-sectional view (along view line 6-6 in FIG. 5) of a groove in a seal slot in a HGP segment, according to embodiments of the disclosure.
Figure 5:
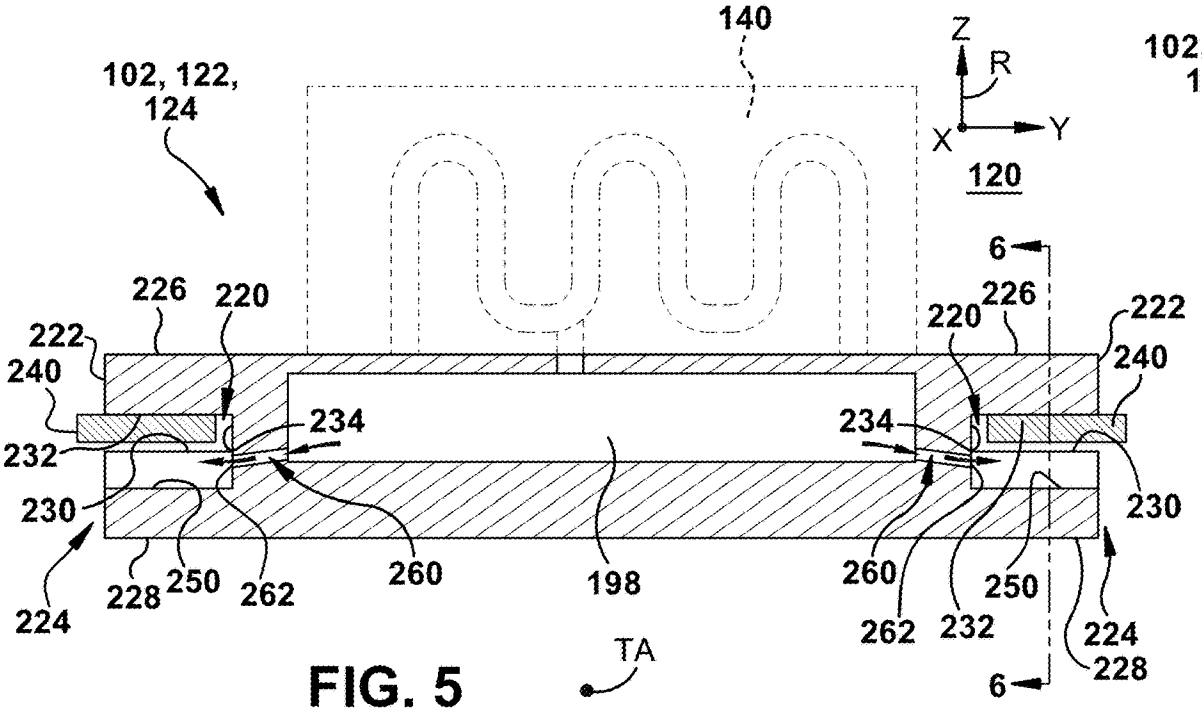
FIG. 5 is a schematic, circumferential cross-sectional view of a seal slot in a HGP segment, according to embodiments of the disclosure.
Figure 7:
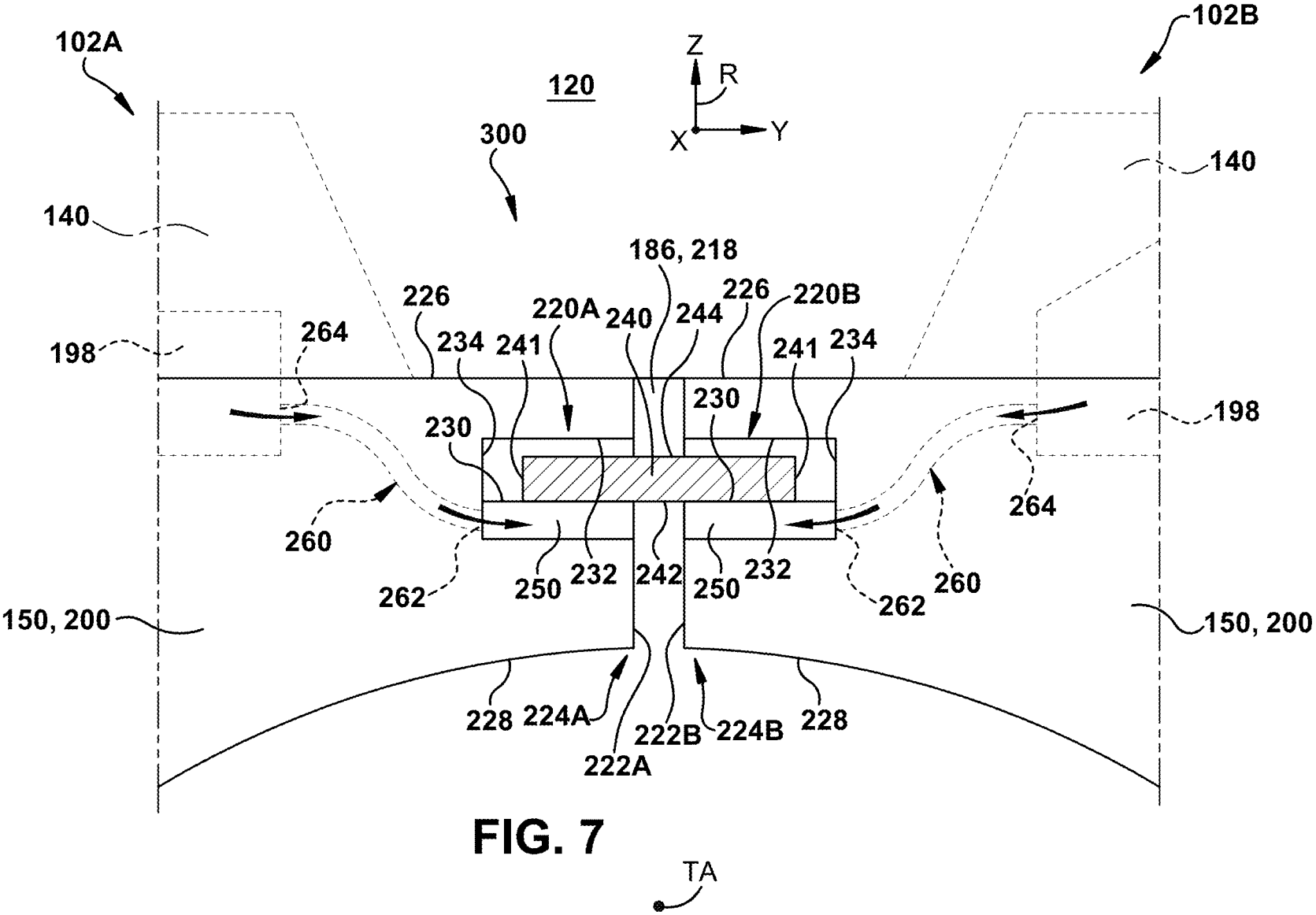
FIG. 7 is an enlarged cross-sectional view of seal slots of a pair of circumferentially adjacent HGP segments, according to embodiments of the disclosure.

FIG. 5 shows a schematic, circumferential cross-sectional view, and FIG. 6 shows a schematic, axial cross-sectional view along view line 6-6 in FIG. 5 of a HGP segment 102 according to embodiments of the disclosure. FIGS. 5 and 6 are arranged to show simplified, schematic versions of HGP segment 102 in both forms of a shroud 122 and a nozzle 124 with airfoil 140 of nozzle 124 shown in dashed lines. FIG. 5 is also arranged to show nozzle 124 at both endwalls 152, 170 (FIG. 3)—it is recognized that for outer endwall 170, FIG. 5 is rotated 180°. FIG. 7 shows an enlarged cross-sectional view of seal slots 220 of a pair of circumferentially adjacent HGP segments 102A, 102B, according to embodiments of the disclosure. While subsequent description of FIGS. 5-7 may refer to stationary HGP segments (i.e., shroud 122 and/or nozzle 124), it should be appreciated that FIGS. 5-7 also schematically illustrate HGP segment 102 in the form of turbine blade 126 with airfoil 140 of blade 126 shown in dashed lines extending from platform surface 302 (FIG. 4B).

As shown in FIGS. 5-7, HGP segments 102 also include a seal slot 220 defined in a face 222 of each side edge, e.g., 224A (FIG. 7), and extending in an axial direction. Note, the "axial direction" means generally axial (e.g., with +/−5°) relative to turbine axis TA and is into the page in FIGS. 5 and 7 and left-right on the page in FIG. 6. (Axial direction is also shown as direction X in the legends in the drawings.) Face 222 extends between surfaces 226, 228. Face 222 can be any of faces 162, 164, 180, 182 of nozzle 124 or faces 210, 212 of shroud 122 as shown FIGS. 3 and 4, respectively. Similarly, outer edge 224 can be any side edges 158, 160, 180, 182 of nozzle 124 or side edges 206, 208 of shroud 122 as shown FIGS. 3 and 4, respectively. The opposite side edge would be the opposing side edge of the first referenced side edge, i.e., see side edges 224A, 224B in FIG. 7. As shown in FIG. 3, faces 162, 164 and faces 180, 182 (only visible for 162, 180) of each nozzle 124 each include seal slot 220 and, as shown in FIG. 4A, faces 210, 212 (only visible for 210) of shroud 122 each include seal slot 220 and, as shown in FIG. 4B, faces 310, 312 (only visible for 310) of blade 126 each include seal slot 220.

Each seal slot 220 has a radial inner wall 230, a radial outer wall 232 and an inner sidewall 234 between radially inner and outer walls 230, 232. The radial inner and radial outer position references are based on the FIGS. 5-7 orientation (radially outward up on page with turbine axis TA on lower part of page); it is recognized the directions may switch position depending on the location of seal slot 220, e.g., in outer endwall 170 (FIG. 3) of nozzle 124. As shown in FIGS. 5-7, each seal slot 220 is configured to receive part of a sealing member 240 extending between seal slots 220 of the circumferentially adjacent segments 102. More particularly, as shown in FIG. 7, sealing member 240 spans between faces 222A, 222B of adjacent segments 102A, 102B to prevent ingestion of combustion gases from hot gas path 120. Sealing member 240 is positioned in respective seal slots 220 that are defined axially with faces 222A, 222B. Any number of seals 240 can be used within a given seal slot 220. Further, for a given face 222, one or more seal 240 and seal slot 220 combinations can be used within the axial extent of the given face 222. Sealing member 240 may include any now known or later developed metal or metal alloy material capable of withstanding the operational environment of GT system 100 (FIG. 1) such as but not limited to a nickel-based or cobalt-based superalloy.

As also shown in FIGS. 5-7, HGP segment 102 also includes at least one groove 250 in at least one of radial inner wall 230 and radial outer wall 232 of each seal slot 220. Groove(s) 250 extend transverse to the axial direction. 'Transverse to the axial direction' means generally circumferentially relative to turbine axis TA (Y-direction), which is left-right on the page in FIGS. 5 and 7, and into the page in FIG. 6. It will be recognized that groove(s) 250 also extend transverse to the axial direction in a radial sense (Z-direction) but, at least in the illustrative embodiments, not to the same extent as the circumferential direction. As shown in FIGS. 5 and 7, each groove 250 extends between inner sidewall 234 of the respective seal slot 220 and face 222 (e.g., face 222A, 222B) of the respective side edge 224. That is, for groove(s) 250, inner sidewall 234 extends further radially beyond the respective radial inner wall 230 (shown) or radial outer wall 232 to define groove(s) 250. Groove(s) 250 hence enlarge a volume of seal slot 220 within whatever wall 230, 232 they are provided in a radial direction and in a circumferential direction (transverse to the axial direction). Groove(s) 250 can also be described as notches or recesses defined in wall(s) 230, 232. Groove(s) 250 can be formed with seal slots 220, e.g., using additive manufacture or casting, or they can be added to seal slots 220, e.g., during repairs of segments 102, by machining such as but not limited to electric discharge machining. Groove(s) 250 can be positioned axially along seal slot 220 at any location desired.

HGP segment 102 also includes a cooling passage 260 defined in the respective segment 102 and having an outlet 262 defined in inner sidewall 234 within groove(s) 250 of respective seal slot 220 and an inlet 264 in fluid communication with an inner coolant source 198 defined in at least in a portion of body 150, 200 of segments 102. Outlet 262 "defined in inner sidewall within groove(s)" 250 indicates that the outlet is wholly within groove 250 such that coolant (arrows) is directed along whatever wall 230, 232 in which groove 250 is formed to cool that structure. In other words, outlet 262 does not radially overlap with a surface that defines seal slot 220, e.g., where groove 250 is in radial inner wall 230, the surface that defines seal slot 220 is that radial inner wall 230. In this manner, the coolant from outlet 262 is not aimed directly at sealing member 240 but toward wall(s) 230, 232 to cool otherwise difficult to cool structures surrounding seal slot 220. Coolant also does not engage a circumferential facing edge 241 (FIG. 7) of sealing member 240. It is noted, however, coolant passing through groove(s) 250 may passively cool sealing member 240 as it moves through groove(s) 250. The coolant exiting groove(s) 250 may also act to prevent ingestion of hot combustion gases from hot gas path 120.

Cooling passage 260 can have any now known or later developed arrangement within segments 102, e.g., shroud 122 and/or nozzle 124. For example, cooling passage 260 can take any path desired in order to fluidly couple to inner coolant source 198 in at least a portion of body 150, 200 of segments 102. FIG. 5 shows a generally straight path for cooling passage 260, which may be advantageous for manufacture by allowing formation of cooling passage 260 using, for example, a drilling system from outside of seal slot 220, e.g., during initial manufacture and/or repairs of segments 102. In this regard, the teachings of the disclosure allow additional cooling without violating any of the machine tolerances regarding seal slots 220. FIG. 7 shows a curved or meandering path for cooling passage 260, which may be formed, for example, by additive manufacturing. While shown as circular in the drawings, cooling passage 260 may also have any cross-sectional shape desired. Inner coolant source 198 can include any now known or later developed source of coolant for shroud 122 or nozzle 124.

For example, as shown in FIG. 3, inner coolant source 198 may be defined in at least a portion of airfoil 140 of nozzle 124, and as shown in FIG. 5, inner coolant source 198 may be defined in at least a portion of endwalls 152, 170 of nozzle 124 (adjacent faces 222). In another example, shown in FIG. 4A, inner coolant source 198 may be defined in at least a portion of shroud body 201 of shroud 122. Inner coolant source 198 for shroud 122 could alternatively be a coolant passage between shroud 122 and an inner coolant passage defined at least in part by the casing of turbine 116 (FIGS. 1-2). In another example, shown in FIG. 4B, inner coolant source 198 may be defined in at least a portion of blade body 301 of blade 126. In any event, coolant can include any now known or later developed coolant used in turbine systems, such as compressed air from compressor 112 (FIG. 1).

Figure 8A:
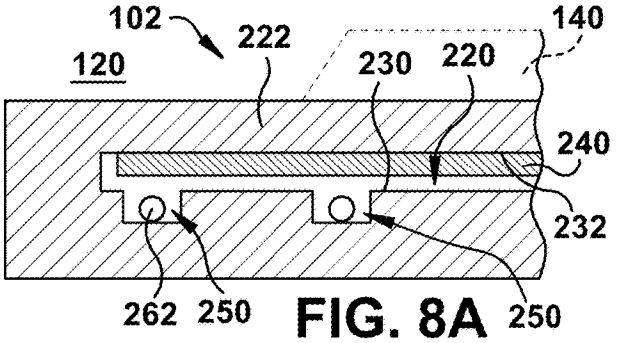
FIGS. 8A-F are schematic, axial cross-sectional views of a groove in a seal slot in a HGP segment, according to various alternative embodiments of the disclosure.
Figure 8B:
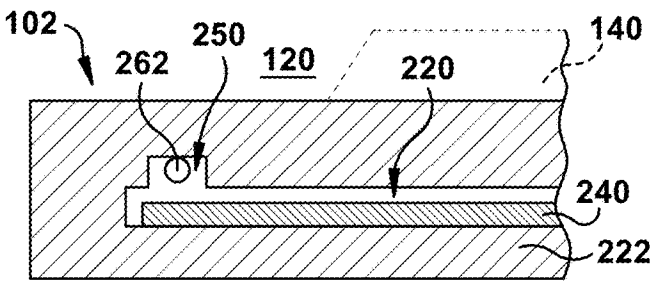
Figure 8C:
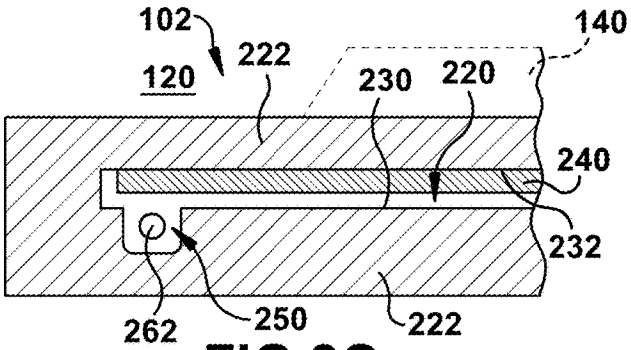
Figure 8D:
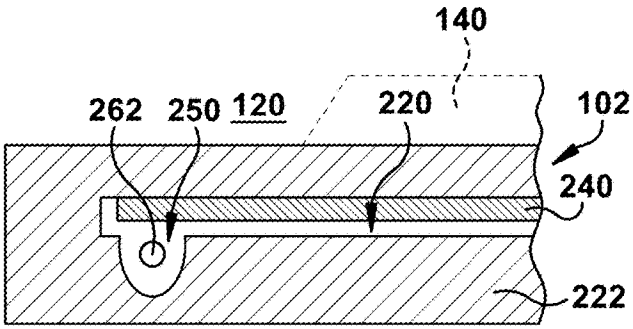

Groove(s) 250 can take a variety of different forms individually and can be arranged in different manners than shown in FIGS. 5-7. FIGS. 8A-F show schematic, cross-sectional views, similar to FIG. 6, of alternative embodiments of grooves 250. FIGS. 8A-F show how the shape of groove(s) 250 may vary, the number of outlets 262 within a groove 250 may vary and the number of grooves 250 may vary. In terms of cross-sectional shape (axially), groove(s) 250 may have, as shown in FIGS. 6 and 8A-B, E and F, a rectangular cross-section; as shown in FIG. 8C, groove(s) 250 may have a rounded rectangular cross-section (i.e., a rectangle with rounded corners); or as shown in FIG. 8D, groove(s) 250 may have a semi-circular (or rounded) cross-section. Other cross-sectional shapes, including asymmetrical shapes, are also possible.

Individual groove(s) 250 or sets of grooves 250 can also have different cross-sectional sizes arranged to provide the desired cooling for wall(s) 230, 232. In certain cases, groove(s) 250 may double the radial height of seal slot 220; however, this is not necessary in all cases. Groove(s) 250 can have any axial and/or radial extent to accommodate as many outlets 262 or size of outlets 262 as desired. In other cases, where cooling passage 260 is formed by drilling, groove(s) 250 may have the smallest possible cross-sectional area possible and still allow drilling through seal slot 220 from outside thereof and into body 150, 200 to reach inner coolant source 198.

Figure 8E:
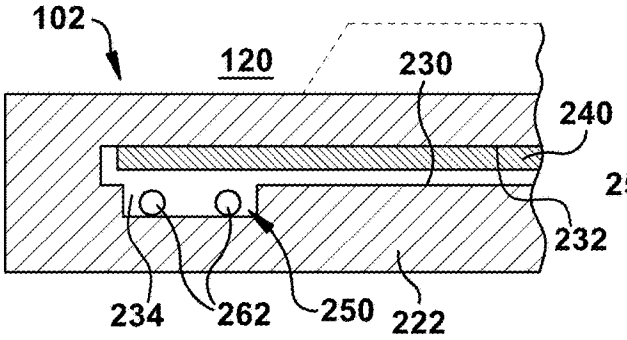
Figure 8F:
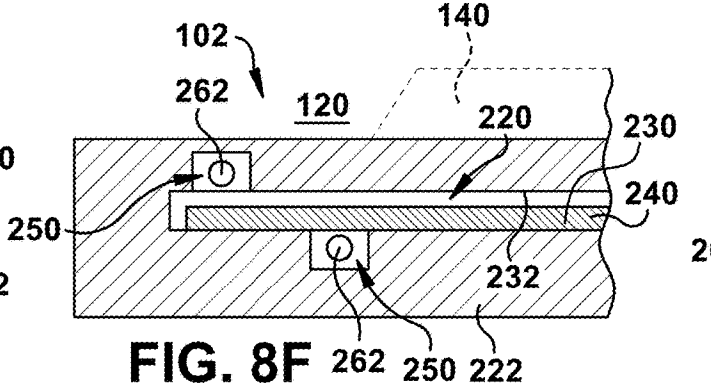

Grooves 250 within a given segment 102 need not all have the same cross-sectional shape and/or size. FIG. 8A shows a plurality of grooves 250 within a given wall 230 (shown), 232. Each groove 250 includes an outlet 262 directed therein, which is fluidly coupled to a respective cooling passage 260. Any number of grooves 250 can be provided in a given wall 230, 232. FIG. 8E shows cooling passage (in page) including a plurality of outlets 262 defined in inner sidewall 234 within at least one groove 250. Any number of outlets 262 can be provided in a given groove 250, and groove(s) 250 can have any desired axial extent (left-right on page of FIG. 8E) to accommodate outlets 262. FIG. 8F shows one or more grooves 250 in radial inner wall 230 and one or more grooves 250 in radial outer wall 232 at the same time to cool portions of both walls. Again, each groove 250 includes outlet(s) 262 directed therein, which are fluidly coupled to a respective cooling passage 260. It will be recognized that the various embodiments illustrated herein may be mixed and matched in any desired manner to provide the desired cooling to segment 102.

Figure 9:
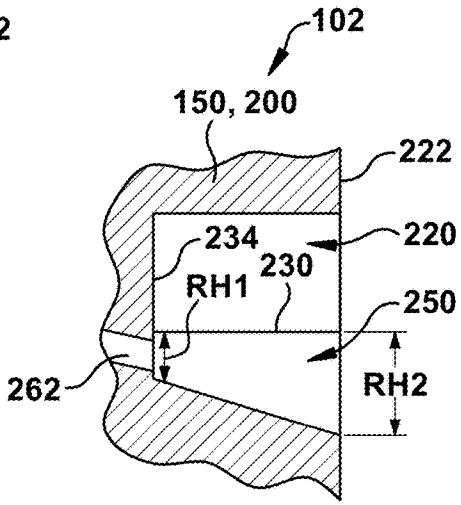
FIG. 9 shows an enlarged, radial cross-sectional view of a groove in a seal slot in a HGP segment, according to another embodiment of the disclosure.

FIG. 9 shows an enlarged, radial cross-sectional view a groove 250 according to another embodiment of the disclosure. In this embodiment, a radial height RH1 of groove(s) 250 at inner sidewall 234 is less than a radial height RH2 of groove(s) 250 at face 222. Here, groove(s) 250 become radially taller or larger as coolant approaches face 222. It is noted that the radial height of a radial height of groove(s) 250 at inner sidewall 234 is equal to radial height of groove(s) 250 at face 222 in the other drawings, e.g., see FIG. 5.

Another embodiment of the disclosure, shown in FIG. 7, includes a joint connection 300 between circumferentially adjacent stationary HGP segments 102A, 102B. More particularly, joint connection 300 can be provided in GT system 100 including at least one stage (with assemblies 128, 131, 132, 135, 136, 139 (FIG. 2)) including a plurality of circumferentially adjacent segments 102. Joint connection 300 can include first and second segments 102A, 102B in the form of turbine nozzles 124 (FIG. 3) or turbine shrouds 122 (FIG. 4A) or turbine blades 126 (FIG. 4B), as described herein. As described relative to FIG. 7, each segment 102A has body 150, 200 including at least one face 222A on side edge 224A of body 150, 200 for abutting a corresponding face 222B on side edge 224B of body 150, 200 of a circumferentially adjacent segment 102B. Joint connection 300 for faces 222A, 222B of the circumferentially adjacent segments 102A, 102B may include the following: First seal slot 220A is defined in first face 222A of a first segment 102A and extends in an axial direction. First seal slot 220A has radial inner wall 230, radial outer wall 232 and inner sidewall 234 between radial inner and outer walls 230, 232. At least one groove 250 is defined in at least one of radial inner and radial outer walls 230, 232 of first seal slot 220A and extends transverse to the axial direction. Each groove 250 also extends between inner sidewall 234 of first seal slot 220A and first face 222A of the respective side edge 224A of first segment 102A. Cooling passage 260 is defined in body 150, 200 of first segment 102A and has outlet 262 defined in inner sidewall 234 within groove(s) 250 and inlet 264 in fluid communication with inner coolant source 198 defined at least in part in body 150, 200 of first segment 102A.

Joint connection 300 also includes the following for circumferentially adjacent HGP segment 102B: Second seal slot 220B is defined in second face 222B of second segment 102B and extending in the axial direction. Second seal slot 220B has radial inner wall 230, radial outer wall 232 and inner sidewall 234 between radial inner and radial outer walls 230, 232 of second seal slot 220B. At least one groove 250 is defined in at least one of radial inner and outer walls 230, 232 of second seal slot 220B and extend transverse to the axial direction. Each groove 250 of second seal slot 220B extends between inner sidewall 234 of second seal slot 220B and second face 222B of respective side edge 224B of second segment 102B. Cooling passage 260 is defined in body 150, 200 of second segment 102B and has outlet 262 defined in inner sidewall 234 within at least one groove 250 in second slot 220B and inlet 264 in fluid communication with inner coolant source 198 defined at least in part in body 150, 200 of second segment 102B.

Joint connection 300 also includes sealing member 240 extending between first and second seal slots 220A, 220B of circumferentially adjacent segments 102A, 102B, i.e., to seal space 186, 218. In at least some embodiments, to accommodate sealing member 240, first and second seal slots 220A, 220B (specifically, radially inner walls 230) are radially aligned with one another. In at least some embodiments, to accommodate sealing member 240, radially inner walls 230 and radially outer walls 232 of first seal slot 220A are radially aligned with radially inner walls 230 and radially outer walls 232 of second seal slot 220B, respectively. Sealing member 240 may include a first side 242 overlying groove(s) 250 in seal slots 220A, 220B of circumferentially adjacent segments 102A, 102B and a second side 244 opposite groove(s) 250. Second side 244 may engage with radial inner wall 230 (as shown) and/or radial outer wall 232 depending on a pressure differential across space 186, 218.

Another embodiment of the disclosure may include a method. As shown in FIG. 7, the method may include providing seal slot 220 in hot gas path (HGP) segment 102A, 102B for GT system 100 (FIG. 1). Segments 102A, 102B may be in the form of turbine nozzles 124 (FIG. 3) or turbine shrouds 122 (FIG. 4A) or turbine blades 126 (FIG. 4B), as described herein. GT system 100 (FIG. 1) includes at least one stage including a plurality of circumferentially adjacent HGP segments 102A, 102B where each HGP segment 102A, 102B includes a body 150, 200 including at least one face 222A, 222B on side edge 224A, 224B of body 150, 200 for addressing a corresponding face 222B, 222A on side edge 224B, 224A of body 150, 200 of an adjacent segment 102B. Seal slot 220A, 220B is defined in each face 222A, 222B and extends in an axial direction. Seal slot 220A, 220B is defined by radial inner wall 230, radial outer wall 232 and inner sidewall 234 between radially inner and outer walls 230, 232 thereof.

The method also includes providing at least one groove 250 defined in one of radial inner and radial outer wall 230, 232 of each seal slot 220A, 220B and extending transverse to the axial direction. Each groove 250 extends between inner sidewall 234 of the respective seal slot 220A, 220B and face 222A, 222B of the respective side edge 224A, 224B. The method also includes providing cooling passage 260 defined in body 150, 200 of segment 102A, 102B and having outlet 262 defined in inner sidewall 234 within groove(s) 250 of seal slot 220A, 220B and inlet 264 in fluid communication with inner coolant source 198 defined in body 150, 200 of segment 102A, 102B. The method may also include providing sealing member 240 in seal slots 220A, 220B of adjacent HGP segments 102A, 102B. As noted, sealing member 240 includes first side 242 overlying groove(s) 250 in seal slots 220A, 220B of circumferentially adjacent segments 102A, 102B and second side 244 opposite groove(s) 250. The method also includes cooling radial inner wall 230 and/or radial outer wall 232 during use of GT system 100, i.e., using cooling passage 260 and groove(s) 250.

HGP segments 102 may include any now known or later developed metal or metal alloy material capable of withstanding the operational environment of GT system 100 (FIG. 1) such as but not limited to a nickel-based or cobalt-based superalloy. HGP segments 102 may be manufactured using any now known or later developed technique such as casting and/or additive manufacture. While not shown for clarity, HGP segments 102 according to embodiments of the disclosure may include any now known or later developed protective coatings thereon, such as a thermal barrier or similar coating. Such protective coatings, if present, may be applied to the entirety or part of the surfaces of segments 102.

Embodiments of the disclosure provide various technical and commercial advantages, examples of which are discussed herein. The HGP segment with the cooling grooves provides additional cooling to normally difficult to cool structure surrounding a seal slot without changing the sealing member or the seal slot. The teachings of the disclosure are easy to manufacture during initial manufacture and/or repair of the segments without violating any tolerances of the seal slots.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−100% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and their practical application and to enable others of ordinary skill in the art to understand the disclosure such that various modifications as are suited to a particular use may be further contemplated.

What is claimed is:

1. A hot gas path (HGP) segment for a gas turbine system including at least one stage including a plurality of circumferentially adjacent HGP segments, the HGP segment comprising:

a body including at least one face on a side edge of the body for addressing a corresponding face on the side edge of the body of an adjacent HGP segment;

a seal slot defined in the face of each side edge and extending in a axial direction toward the opposite side edge, each seal slot having a radial inner wall, a radial outer wall and an inner sidewall between the radially inner and outer walls, wherein each seal slot is configured to receive part of a sealing member extending between the seal slots of the circumferentially adjacent HGP segments;

at least one groove defined in at least one of the radial inner or radial outer wall of each seal slot and extending transverse to the axial direction, each groove extending between the inner sidewall of the respective seal slot and the face of the respective side edge, wherein a radial height of the at least one groove at the inner sidewall is less than a radial height of the at least one groove at the at least one face; and a cooling passage defined in the respective HGP segment and having an outlet defined in the inner sidewall within the at least one groove of the respective seal slot and an inlet in fluid communication with an inner coolant source defined in the body.

2. The HGP segment of claim 1, wherein the HGP segment is a turbine nozzle, and the body includes:

an airfoil including a tip and a root;

a first endwall connected to the airfoil at the tip;

a second endwall connected to the airfoil at the root;

wherein each of the first and second endwalls include the at least one face; and wherein the inner coolant source is defined in at least a portion of the airfoil.

3. The HGP segment of claim 1, wherein the HGP segment is a turbine shroud, and the body includes:

a shroud body including the at least one face;

wherein the inner coolant source is defined in at least a portion of the shroud body.

4. The HGP segment of claim 1, wherein the at least one groove includes a plurality of grooves, each groove with a respective outlet directed therein.

5. The HGP segment of claim 1, wherein the at least one groove includes one or more grooves in the radial inner wall and one or more grooves in the radial outer wall, each groove with a respective outlet directed therein.

6. The HGP segment of claim 1, wherein the cooling passage includes a plurality of outlets defined in the inner sidewall within the at least one groove.

7. The HGP segment of claim 1, wherein the at least one groove has one of a rectangular cross-section, a semi-circular cross-section or a rounded rectangular cross-section.

8. In a gas turbine system including at least one stage including a plurality of circumferentially adjacent segments, each segment having a body including at least one face on a side edge of the body for addressing a corresponding face on the side edge of the body of a circumferentially adjacent segment, a joint connection for the faces of the circumferentially adjacent segments comprises:

a first seal slot defined in a first face of a first segment and extending in an axial direction, the first seal slot having a radial inner wall, a radial outer wall and an inner sidewall between the radial inner and outer walls, at least one groove defined in at least one of the radial inner or radial outer wall of the first seal slot and extending transverse to the axial direction, each groove extending between the inner sidewall of the first seal slot and the first face of the respective side edge of the first segment wherein a radial height of the at least one groove in the first seal slot at the inner sidewall of the first seal slot is less than a radial height of the at least one groove at the at least one face of the first seal slot, and a cooling passage defined in the body of the first segment and having an outlet defined in the inner sidewall within the at least one groove and an inlet in fluid communication with an inner coolant source defined at least in part in the body of the first segment;

a second seal slot defined in a second face of a second segment and extending in the axial direction, the second seal slot having a radial inner wall, a radial outer wall and an inner sidewall between the radial inner and radial outer wall of the second seal slot, at least one groove defined in at least one of the radial inner or outer walls of the second seal slot and extending transverse to the axial direction, each groove of the second seal slot extending between the inner sidewall of the second seal slot and the second face of the respective side edge of the second segment wherein a radial height of the at least one groove in the second seal slot at the inner sidewall of the second seal slot is less than a radial height of the at least one groove at the at least one face of the second seal slot, and a cooling passage defined in the body of the second segment and having an outlet defined in the inner sidewall within the at least one groove in the second seal slot and an inlet in fluid communication with an inner coolant source defined at least in part in the body of the second segment; and a sealing member extending between the first and second seal slots of the circumferentially adjacent segments.

9. The joint connection of claim 8, wherein the sealing member includes a first side overlying the at least one groove in the seal slots of circumferentially adjacent segments and a second side opposite the at least one groove in the seal slots.

10. The joint connection of claim 8, wherein the first and second segments are turbine nozzles, the body of each turbine nozzle including:

an airfoil including a tip and a root;

a first endwall connected to the airfoil at the tip;

a second endwall connected to the airfoil at the root;

wherein each of the first and second endwalls include the at least one face; and wherein the inner coolant source is defined in at least a portion of the airfoil.

11. The joint connection of claim 8, wherein the first and second segments are turbine shrouds, the body of each turbine shroud including:

a shroud body including the at least one face;

wherein the inner coolant source is defined in at least a portion of the shroud body.

12. The joint connection of claim 8, wherein the at least one groove of at least one of the first seal slot and the second seal slot includes a plurality of grooves, each groove having an outlet of the cooling passage therein.

13. The joint connection of claim 8, wherein the at least one groove of at least one of the first seal slot and the second sea slot includes one or more grooves in the radial inner wall and one or more grooves in the radial outer wall, each groove having a respective outlet of the cooling passage therein.

14. The joint connection of claim 8, wherein the cooling passage defined in the body of at least one of the first segment and the second segment includes a plurality of outlets defined in the inner sidewall within the at least one groove.

15. The joint connection of claim 8, wherein the at least one groove has one of a rectangular cross-section, a semi-circular cross-section or a rounded rectangular cross-section.

16. A method, comprising:

providing a seal slot in a hot gas path (HGP) segment for a gas turbine system including at least one stage including a plurality of circumferentially adjacent HGP segments where each HGP segment includes a body including at least one face on a side edge of the body for addressing a corresponding face on the side edge of the body of an adjacent HGP segment, wherein the seal slot is defined in each face and extends in an axial direction, the seal slot having a radial inner wall, a radial outer wall and an inner sidewall between the radially inner and outer walls thereof;

providing at least one groove defined in at least one of the radial inner or radial outer wall of each seal slot and extending transverse to the axial direction, each groove extending between the inner sidewall of the respective seal slot and the face of the respective side edge, wherein a radial height of the at least one groove at the inner sidewall is less than a radial height of the at least one groove at the at least one face;

providing a cooling passage defined in the body of the segment and having an outlet defined in the inner sidewall within the at least one groove of the seal slot and an inlet in fluid communication with an inner coolant source defined in the body of the segment; and cooling at least one of the radial inner wall or the radial outer wall during use of the gas turbine.

17. The method of claim 16, further comprising providing a sealing member in seal slots of adjacent HGP segments, the sealing member including a first side overlying the at least one groove in the seal slots of circumferentially adjacent HGP segments and a second side opposite the at least one groove.

18. The method of claim 16, wherein the at least one groove includes a plurality of grooves, each groove having a respective outlet directed therein.

19. The method of claim 16, wherein the at least one groove includes one or more grooves in the radial inner wall and one or more grooves in the radial outer wall, each groove with a respective outlet directed therein.

20. The method of claim 16, wherein the cooling passage includes a plurality of outlets defined in the inner sidewall within the at least one groove.

* * * * *